US006679728B1

(12) United States Patent
Huang et al.

(10) Patent No.: US 6,679,728 B1
(45) Date of Patent: Jan. 20, 2004

(54) MINI BNC CONNECTOR

(75) Inventors: Tung-Liang Huang, Hsin-Tien (TW); Sung-Wen Chen, Hsin-Tien (TW)

(73) Assignee: Insert Enterprise Co., Ltd., Taipei Hsien (TW)

( * ) Notice: Subject to any disclaimer, the term of this patent is extended or adjusted under 35 U.S.C. 154(b) by 3 days.

(21) Appl. No.: 10/329,344

(22) Filed: Dec. 27, 2002

(51) Int. Cl.[7] ..... H01R 9/05

(52) U.S. Cl. ..... 439/579; 439/188; 439/578; 439/585; 439/582; 439/581; 333/124; 333/127; 333/22 R; 333/105; 200/51.09; 200/51.1; 200/51.11

(58) Field of Search ..... 439/579, 188, 439/578, 585, 582, 581; 333/124, 127, 22 R, 105; 200/51.09, 51.1, 51.11

(56) References Cited

U.S. PATENT DOCUMENTS 3,360,747 A * 12/1967 Lancaster ..... 333/105
3,372,349 A * 3/1968 Concelman ..... 333/105
4,749,968 A * 6/1988 Burroughs ..... 333/105
5,088,936 A * 2/1992 Wang ..... 439/578
5,221,090 A * 6/1993 Hong ..... 473/391
5,246,378 A * 9/1993 Seiceanu ..... 439/188
5,348,491 A * 9/1994 Louwagie et al. ..... 439/188
6,036,545 A * 3/2000 Caviness et al. ..... 439/620

* cited by examiner

*Primary Examiner*—Dean A. Reichard
*Assistant Examiner*—Anton Harris
(74) *Attorney, Agent, or Firm*—Troxell Law Office PLLC

(57) ABSTRACT

A mini BNC connector, which provides a better signal transmission quality and can be fabricated conveniently, includes a metal outer casing with two locating cylinders and a joining chamber communicating with the two cylinders, two insulators fitted in the locating cylinders respectively with each of the two insulators having a piercing hole, two terminals joined to the piercing holes respectively with a tail section respectively extending to the joining chamber, two conductors connected to the tail sections respectively and a further insulator having two through holes joined to the conductors respectively and fitting with the inner side of the joining chamber so as to fix the conductors.

10 Claims, 5 Drawing Sheets

MINI BNC CONNECTOR

BACKGROUND OF THE INVENTION

1. Field of the Invention

The present invention relates to a BNC connector, and particularly to a mini sized and easily fabricated BNC connector.

2. Description of Related Art

Publication No. 308366 in the Taiwanese Patent Gazette, entitled "DUAL TYPE BNC CONNECTOR (ADDITION I)", granted to the present applicant discloses a dual body type BNC connector with a metal outer casing. The dual type BNC connector is attached to a circuit board for connecting with other BNC connectors. In order to enhance signal transmission quality of the BNC connector with metal outer casing, the applicant has filed an invention in Taiwan with Application No. 91206496 and in U.S. with application Ser. No. 10/173,462, entitled BNC CONNECTOR WITH ALL METAL OUTER CASING. The invention basically has a metal cover is jointed to an outer casing at the lower end thereof to constitute a space for receiving the BNC connector and the lead wires extending from the rear side of the BNC connector. Hence, the power loss rate of the BNC connector during the signal being transmitted can be reduced and the electromagnetic wave interference generated by the foreign electronic parts can be isolated so as to enhance the quality of the transmitted signal.

However, the preceding BNC connectors are large sized and it is a trend that smaller sized BNC connectors are needed. In order to comply with the trend, the present invention discloses a mini BNC connector providing better signal transmission quality and being fabricated more conveniently.

SUMMARY OF THE INVENTION

Accordingly, an object of the present invention is to provide a mini BNC connector, which is possible to improve the quality of signal transmission and to be fabricated with facility.

BRIEF DESCRIPTION OF THE DRAWINGS

The present invention can be more fully understood by reference to the following description and accompanying drawing, in which.

DETAILED DESCRIPTION OF THE PREFERRED EMBODIMENTS

Figure 1:
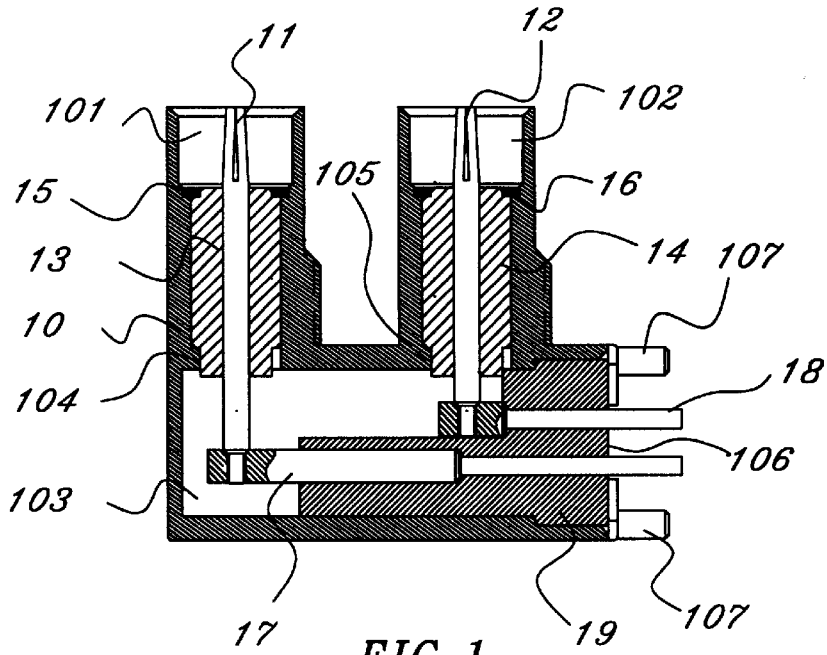
FIG. 1 is a sectional view of a mini BNC connector according to the present invention.
Figure 2:
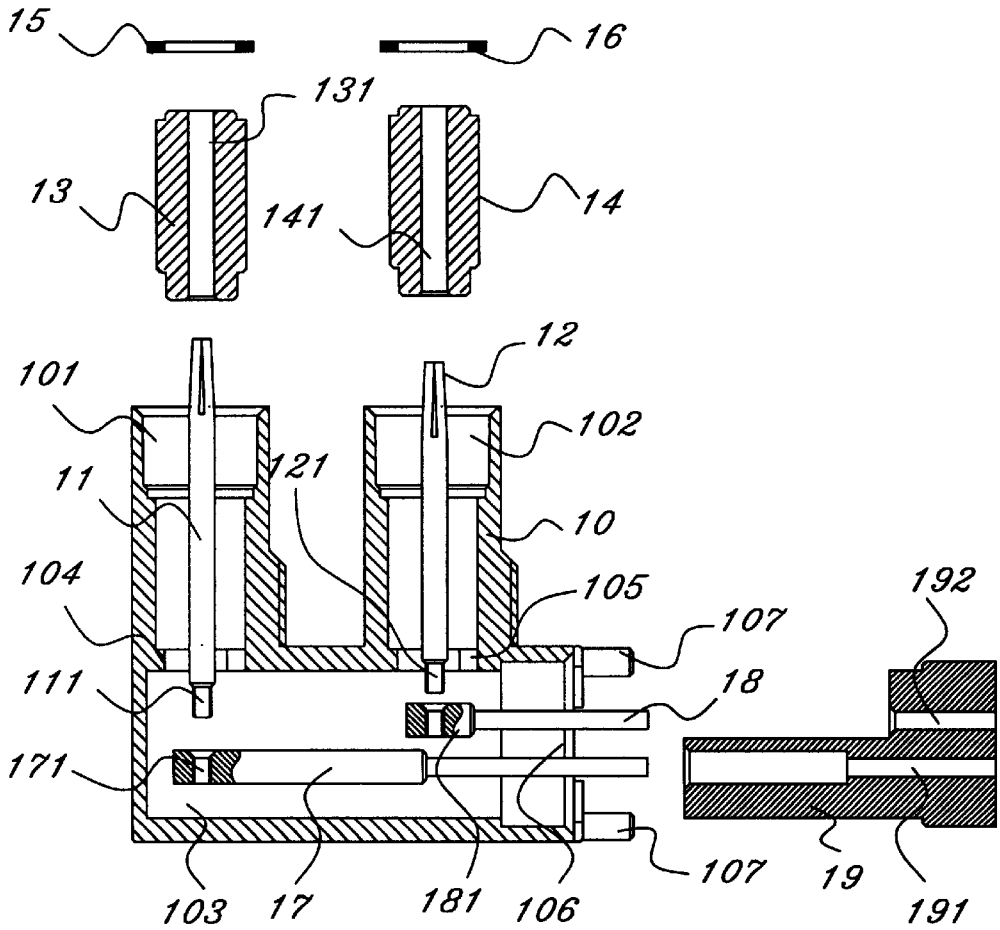
FIG. 2 is a plan view illustrating the mini BNC connector shown in FIG. 1 in a state of being disassembled.
Figure 5:
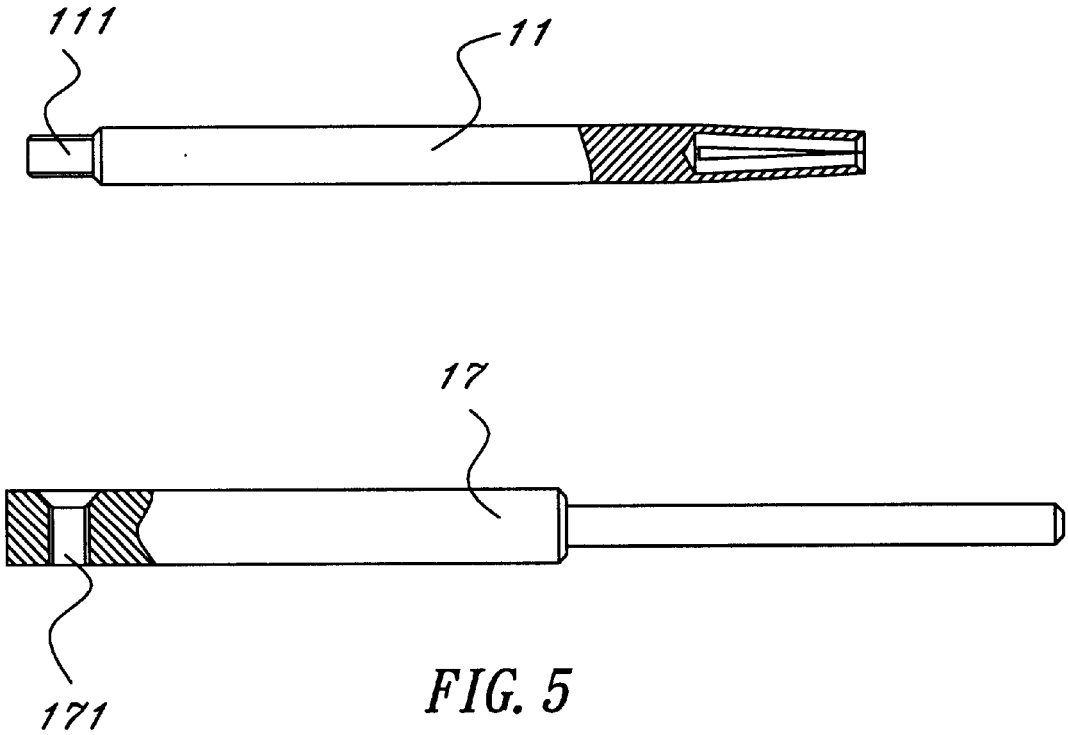
FIG. 5 is a partial sectional view of a terminal and a conductor of the mini BNC connector according to the present invention.

Referring to FIGS. 1, 2 and 5, a mini BNC connector of the present invention in a first embodiment thereof has a metal outer casing 10 and the metal outer casing 10 further has two parallel locating cylinders 101, 102 and a joining chamber 103 communicating with both the inner ends of the locating cylinders 101, 102. The two locating cylinders 101, 102 at inner sides thereof are inserted with a terminal 11, 12, an insulator 13, 14 and a packing ring 15, 16 respectively. The locating cylinders 101, 102 at the inner end thereof provides a rib 104, 105 to fix the insulator 13, 14 in place respectively. The insulator 13, 14 has an outer diameter slightly smaller than the locating cylinders 101, 102 respectively and the insulator 13, 14 at the circumference of the upper end thereof is fitted with the packing ring 13, 14 respectively so that the respective insulator 13, 14 can be fixedly attached to the inner side of the locating cylinders 101, 102. The two insulator 13, 14 have a piercing hole 131, 141 respectively to engage with the two terminals 11, 12 so that the terminals 11, 12 can be fixedly attached to the locating cylinders 101, 102 at inner sides thereof. The terminals 11, 12 have a tail sections 111, 121 extending to the joining chamber 103. In the present embodiment, the two tail sections 111, 121 at a respective rear end thereof have thread screws to engage with corresponding threaded screw holes of joining parts 171, 181 on the conductors 17, 18 so that the terminals 11, 12 can connect with the conductors 17, 18. A further conductor 19 has two through holes 191, 192 for joining with the conductors 17, 18 respectively and fitting with the inner side of an opening end 106 of the joining chamber 103 so that the conductors 17, 18 can be fixedly mounted and extend outward the joining chamber 103. The metal outer casing 10 has an insert leg 107 disposed at the outer side of the joining chamber 103 for being inserted into an engaging hole in a circuit board. Because the conductors 17, 18 are contained in the metal outer casing 10 and it is possible to reduce power loss during the BNC connector transmitting signals and, in the mean time, it is possible to completely resist electromagnetic waves emitted by other electronic parts disposed outside the BNC connector so that the transmitting signals can be free from being interfered so as to enhance the quality of signal transmission of the BNC connector effectively. Further, the metal outer casing 10 is integrally made without the need of joining a metal cover additionally as done in the preceding mentioned Taiwanese and U.S. patent applications so that it is much more convenient while the metal outer casing is fabricated.

While the mini BNC connector of the present invention is assembled, the terminals 11, 12 are joined to the conductors 17, 18 first and then the further insulator 19, the insulators 13, 14 and the packing rings 15, 16 so that the terminals 11, 12 can be connected to the outer side of the metal outer casing 10 by way of the conductors 17, 18. Hence, it is very easy to set up the mini BNC connector.

Figure 3:
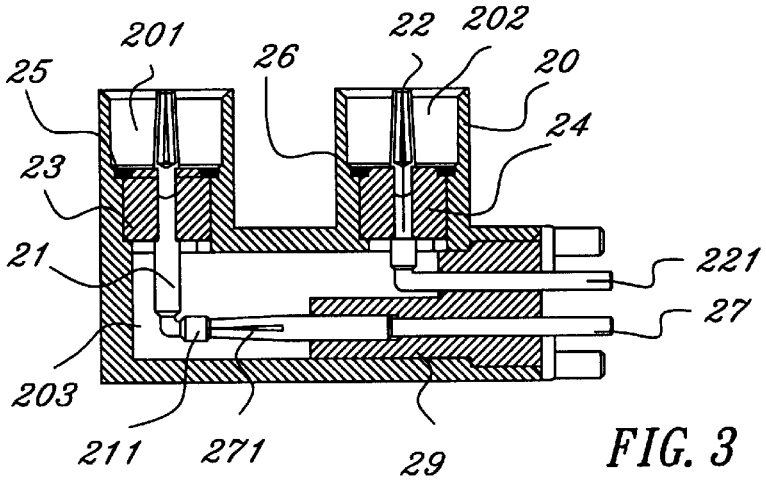
FIG. 3 is a sectional view of the mini BNC connector in another embodiment of the present invention.
Figure 4:
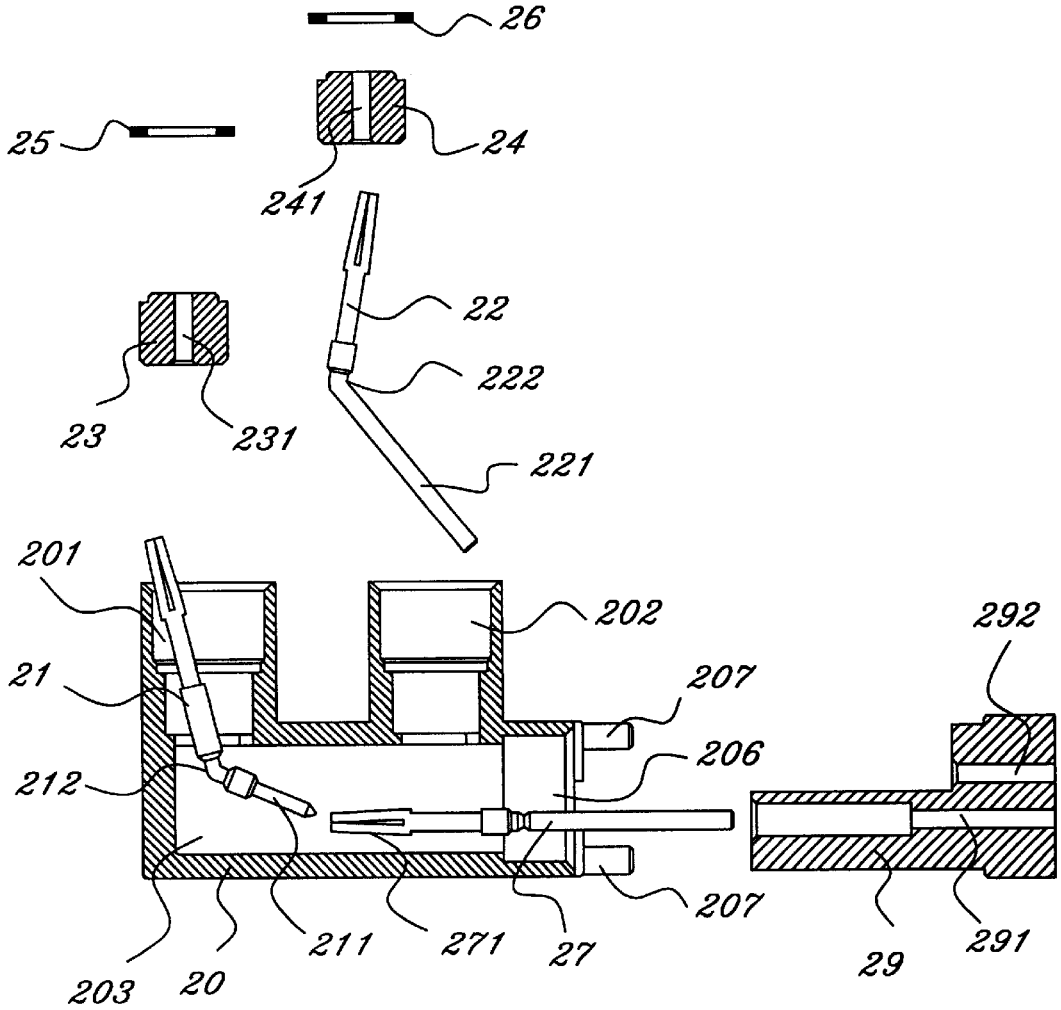
FIG. 4 is a plan view illustrating the mini BNC connector shown in FIG. 3 in a state of being disassembled.
Figure 6:
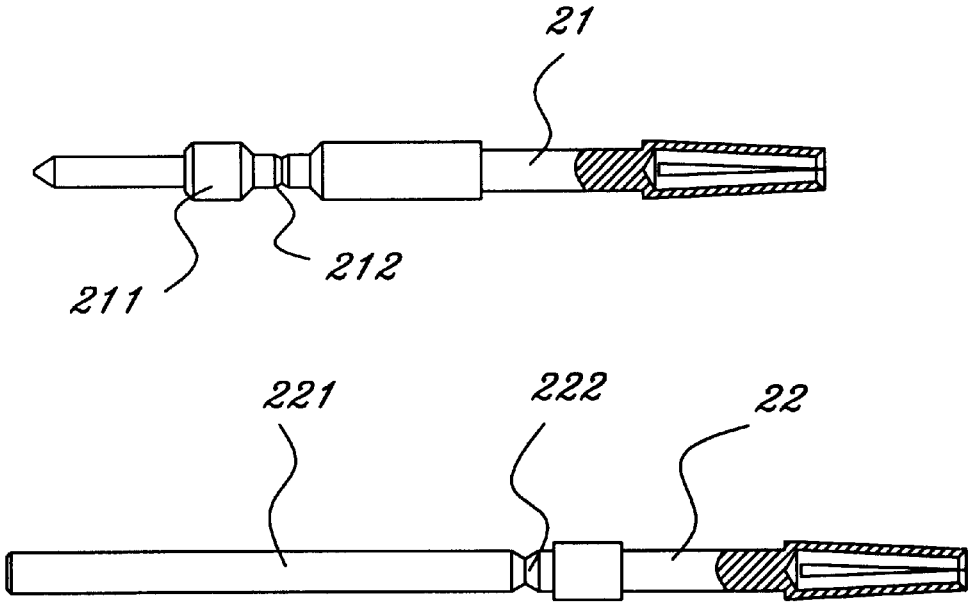
FIG. 6 is a partial sectional view of two terminals in another embodiment of the present invention shown in FIGS. 3 and 4.

Referring to FIGS. 3, 4 and 6, another embodiment of the present invention is illustrated. The mini BNC connector shown in FIGS. 3, 4 and 6 provides most parts such as an outer casing 20, three insulators 23, 24, 29 and two packing rings similar to those shown in FIGS. 1 and 2 except two terminals and two conductors being different from the first embodiment in their shapes.

Both the terminals 21, 22 shown in FIG. 6 have a tail section 211, 221 respectively and each of the tail sections 211, 221 at a bent spot thereof is provided with a surrounding recess ring 212, 222 respectively so as to fix bent spot in place and allow the tail sections 211, 221 being bent 90 degrees at the positions of the two recess rings 212, 222.

It can be seen that a distance to the opening 206 of the joining chamber 203 from the locating cylinder 202 is shorter so that the tail section 221 of the terminal 22 can be slightly bent to extend the tail section 221 outward the opening 206 of the joining chamber 203 and then bent 90 degrees at the recess ring 222. It is farther from the locating cylinder 201 to the opening 206 of the joining chamber 203 such that it is inconvenient for the tail section 211 to extend outward the opening 206 regardless being slightly bent and a further conductor 27 is required to connect the rear end of the tail section 211. The conductor 27 at the connecting section 271 thereof has a joint groove for fitting with the tail section 211. It is preferable that the tail section 211 at the rear end thereof has a shape of sharp cone so as to fit with the joint groove of the connecting section 271. After the tail section 211 being fitted to the connecting section 271, the conductor 27, which has extended outside the opening 206, and the terminal 21, which has extended outside the locating cylinder 201, actuate the tail section 211 to bend 90 degrees at the recess ring 212. The insulator 29 at two through holes 291, 292 thereof fits with the conductor 27 and the tail section 221 of the terminal 22 respectively and the insulator 29 is inserted into the joining chamber 203 to block the opening 206. Further, the two insulators 23, 24 with piercing holes 231, 241 thereof engage with two terminals 21, 22 respectively and the two insulators 23, 24 then are fixedly attached in the two locating cylinders 201, 202 respectively by way of two packing rings 25, 26 to complete assembling the mini BNC connector.

It is a feature of the present invention that the terminals are specially designed to join the conductors so as to allow the terminals and the conductors being able to bent 90 degrees in a very small space without occurring distortion. Hence, the signal transmission lines can be bent smoothly to maintain a preferable quality of signal transmission. Further, the special design of the terminals and the conductors leads to the mini BNC connector being set up and fabricated easily.

Figure 7:
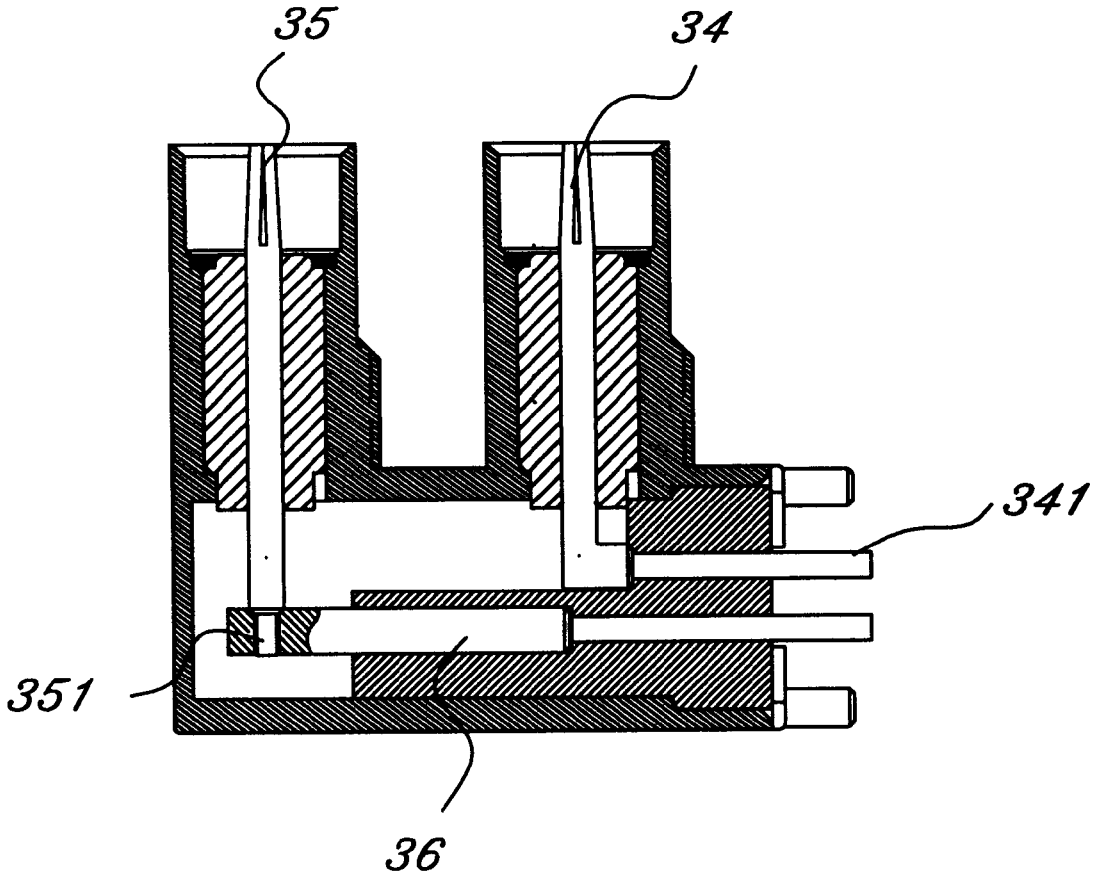
FIG. 7 is a sectional view of the mini BNC connector in a further embodiment of the present invention.

Referring to FIG. 7, a further embodiment of the mini BNC connector according to the present invention is illustrated. A terminal 34 with a directly bent tail section 341 and an another terminal 35 with a tail section 351 having screw threads are adopted in the embodiment. The tail section 351 at the rear screw thread thereof engages with a corresponding threaded hole in the conductor 36.

Figure 8:
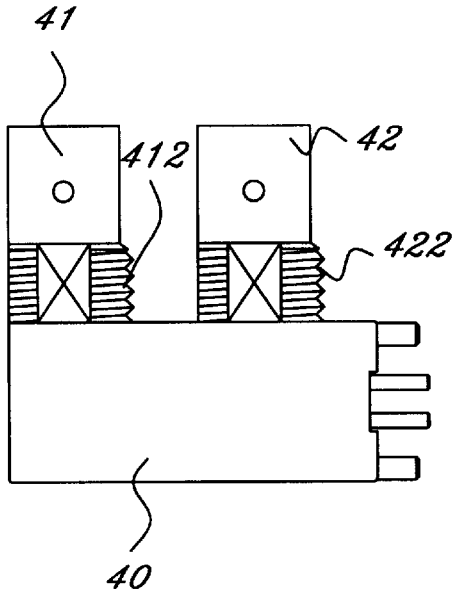
FIG. 8 is a side view of the mini BNC connector in a further embodiment of the present invention.
Figure 9:
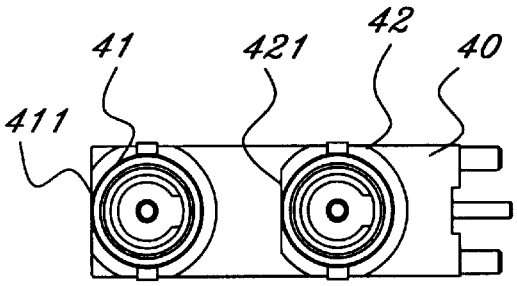
FIG. 9 is a top view of the mini BNC connector in a further embodiment shown in FIG. 8.

Referring to FIGS. 8 and 9, a further embodiment of the mini BNC connector according to the present invention is illustrated. The outer casing 40 at two locating cylinders 41, 42 has an outer flat part 411, 421 respectively and at the outer side thereof is provided with screw threads 412, 422 close to the joining chamber for engaging with nuts or screw holes of other fixing components.

Figure 10:
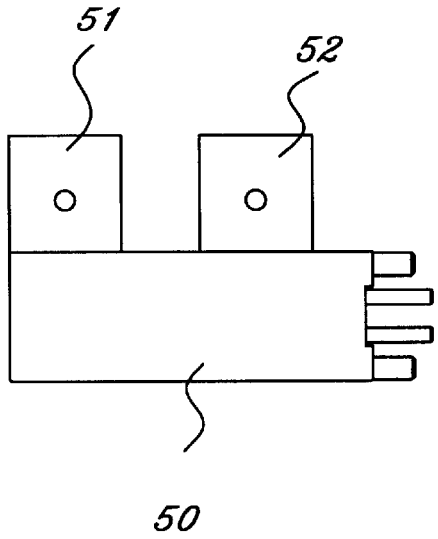
FIG. 10 is a side view of a mini connector according to the present invention in a further embodiment thereof.
Figure 11:
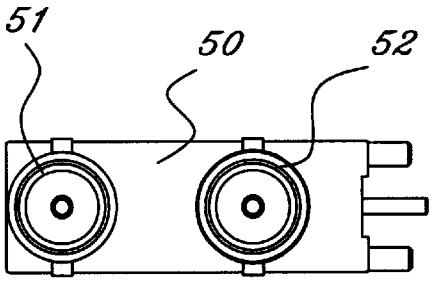
FIG. 11 is a top view of the mini BNC connector shown in FIG. 10.

Referring to FIGS. 10 and 11, a further embodiment of the mini BNC connector according to the present invention is illustrated. The outer casing 50 has locating cylinders 51, 52 thereof with a cylindrical shape respectively.

While the invention has been described with reference to preferred embodiments thereof, it is to be understood that modifications or variations may be easily made without departing from the spirit of this invention, which is defined by the appended claims.

What is claimed is:

1. A mini BNC connector, comprising:

a metal outer casing having two locating cylinders and a joining chamber with an opening communicating with the two cylinders;

two insulators fitted in the locating cylinders respectively and each of the two insulators having a piercing hole;

two conductors connected to the tail sections respectively; and a further insulator having two through holes joined to the conductors respectively and fitting with the joining chamber at an inner side thereof so as to fix the conductors, wherein each of the locating cylinders having an inner rib to fixedly locate each of the insulators, wherein each of the insulators at an upper end thereof is surrounded with a packing ring so as to be fixed in the two locating cylinders respectively.

2. The mini BNC connector according to claim 1, wherein the tail section on each of the terminals has a thread screw rear end and each of the conductors has a corresponding threaded hole to engage with the thread screw rear end respectively.

3. The mini BNC connector according to claim 1, wherein one of the terminals lis close to the opening of the joining chamber with the tail section thereof being integral with the conductor.

4. The mini BNC connector according to claim 1, wherein the each of the locating cylinders at an circumference thereof has a flat part and has thread screw next to an outer side of the joining chamber.

5. The mini BNC connector according to claim 1, wherein each of the locating cylinders is cylindrical.

6. The mini BNC connector according to claim 3, wherein the tail section on said terminal has a bent spot being surrounded with a recess ring.

7. The mini BNC connector according to claim 3, wherein another one of the conductors has a joint groove and another one of the terminals is farther from the opening of the joining chamber with the trail section thereof being bent and a rear end thereof fitting with the joint groove of said conductor.

8. The mini BNC connector according to claim 3, wherein the farther terminal at the tail section thereof has a thread screw rear end and the other conductor has a corresponding threaded hole to engage with the thread screw rear end.

9. The mini BNC connector according to claim 7, wherein the tail section of the other terminal at the bent spot thereof has an outer recess ring.

10. The mini BNC connector according to claim 9, wherein the rear end of the tail section on the other terminal has a shape of sharp cone.

* * * * *